US006604520B2

(12) United States Patent
Grimm et al.

(10) Patent No.: US 6,604,520 B2
(45) Date of Patent: Aug. 12, 2003

(54) VAPOR EXTRACTION DEVICE DISPOSED IN THE REGION NEXT TO OPEN HOT-FOOD AREAS

(75) Inventors: Maximilian Grimm, Stuttgart (DE); Armin Zibold, Bretten (DE); Ulrich Gremmelmaier, Bretten (DE); Martin Wetzel, Rastatt (DE); Martin Kornberger, Baden-Baden (DE); Michael Wendt, Bietigheim (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 09/933,047

(22) Filed: Aug. 20, 2001

(65) Prior Publication Data

US 2002/0029696 A1 Mar. 14, 2002

Related U.S. Application Data

(63) Continuation of application No. PCT/EP00/01081, filed on Feb. 10, 2000.

(30) Foreign Application Priority Data

Feb. 19, 1999 (DE) ..... 199 07 057

(51) Int. Cl.[7] ..... F24C 15/20
(52) U.S. Cl. ..... 126/299 D; 126/299 R

(58) Field of Search ..... 126/299 R, 299 C, 126/299 F, 299 E, 299 D, 300, 301, 302, 303; 55/DIG. 36; 454/67

(56) References Cited

U.S. PATENT DOCUMENTS

| | | | | |
|---|---|---|---|---|
| 245,689 A | * | 8/1881 | Young | |
| 2,554,694 A | * | 5/1951 | Belt | |
| 2,974,663 A | * | 3/1961 | Humert | |
| 4,934,337 A | * | 6/1990 | Falk | |

FOREIGN PATENT DOCUMENTS

| | | | | |
|---|---|---|---|---|
| DE | 35 03 236 | * | 8/1986 | ..... 126/299 D |
| JP | 60-30916 | * | 2/1985 | ..... 126/300 |
| JP | 360185035 | * | 9/1985 | ..... 126/299 D |
| JP | 63-267854 | * | 4/1988 | ..... 126/299 D |
| JP | JP 63-150530 | * | 6/1988 | ..... 126/299 E |
| JP | 403158640 | * | 7/1991 | ..... 126/299 D |
| WO | WO 00/49341 | * | 8/2000 | ..... 126/299 D |

* cited by examiner

*Primary Examiner*—Carl D. Price
(74) *Attorney, Agent, or Firm*—Laurence A. Greenberg; Werner H. Stemer; Ralph E. Locher

(57) ABSTRACT

The vapor extraction device is disposed, for example, in a kitchen counter top next to the cooking or other hot-food area, specifically so as to be retracted in the position of rest. To operate as a suction device, the intake the vapor extraction device is moved out upward and pivoted over and above food preparation carriers disposed on the hot-food areas.

15 Claims, 4 Drawing Sheets

VAPOR EXTRACTION DEVICE DISPOSED IN THE REGION NEXT TO OPEN HOT-FOOD AREAS

CROSS-REFERENCE TO RELATED APPLICATION

This application is a continuation of copending International Application No. PCT/EP00/01081, filed Feb. 10, 2000, which designated the United States.

BACKGROUND OF THE INVENTION

Field of the Invention

The invention relates to a vapor extraction device disposed in the region next to cooking or other open hot-food areas for food preparation. The extraction device has an intake device, disposed approximately in the plane of the open hot-food areas, for the vapors emanating from these areas, and a suction device for discharging these vapors.

In order to draw away cooking or other hot-food vapors, it is customary, even at the household level, to employ vapor extraction hoods or vapor extraction chimneys that are disposed above the cooking point or hot-food point. The vapors rising during the thermal preparation of foods are picked up by these devices, normally filtered and usually blown through a fan into the open, but sometimes also back into the work space.

However, configurations that have their intake orifices laterally next to the hot-food region are also in the prior art. With regard to fryers or grills, the prior art also includes measures for drawing away vapors. The suction devices are disposed next to the fryers or grills in the operating plane of the devices and, thus, discharge to the side and downward the vapors that are emitted during the respective hot-food preparation process. For such a purpose, blowers with high air delivery capacities are required because the suction flow direction is not in the natural upward direction of propagation of the hot-food vapors. Nonetheless, as compared with the vapor extraction hoods and vapor extraction chimneys disposed above the hot-food areas, the vapor extraction measures disposed laterally next to the hot-food areas have an advantage that the region above the hot-food areas is more freely accessible and visible.

SUMMARY OF THE INVENTION

It is accordingly an object of the invention to provide a vapor extraction device disposed in the region next to cooking or other open hot-food areas that overcomes the hereinafore-mentioned disadvantages of the heretofore-known devices of this general type and that can be positioned with its intake region in relation to the hot-food point, as required, and that, nevertheless, enables the operator to have advantageous access to the food in preparation and a convenient view of it during the preparation process.

With the foregoing and other objects in view, there is provided, in accordance with the invention, a vapor extraction device disposed in a region next to a cooking or open hot-food area for food preparation, including a suction device for moving and discharging vapors from the open hot-food area, a length-compensating pipe having a pipe axis, the pipe fluidically connected to the suction device, and an intake. The intake has an elongated intake section for receiving the vapors emanating from the area, a height adjustment device, and a pivot. The intake section has end sections, one of which defining an opening connected to the pipe and fluidically coupled to the suction device therethrough. The height adjustment device moves the intake section from a closed position approximately at the plane of the area to open positions at different vertical heights above the plane above a food preparation container. The pivot has a pivot axis passing through a pivot point of the opening and corresponding to the pipe axis. The pivot moves the intake section about the pivot axis as a function of a vertical position of the intake section and to a position over the container placed at the area. The intake, pivot axis, pipe, and pipe axis are disposed at a side of the area A vapor extraction device having these features according to the invention can be operated in the same way as a conventional suction device disposed next to a hot-food area, for example, a fryer or a grill, in that the intake region of the vapor extraction device is moved slightly out of the retracted position of rest. Although further outward movement impairs access from the side to the thermally treated food in preparation, it increasingly improves the suction action on the hot-food vapors emitted.

Preferably, however, in the state in which it is moved out upward to a greater or lesser extent, the intake device is also disposed in a manner to be pivoted out over the open hot-food area or a food preparation container placed onto the open hot-food area, so that the hot-food vapors emitted can be drawn in and discharged in a particularly intensive and safeguarded manner.

In accordance with another feature of the invention, there are provided a motor drive and a gear assembly connected to the motor drive. The gear assembly is connected to the height adjustment device and the motor drive drives the height adjustment device through the gear assembly.

A drive motor preferably serves for adjusting the height of the intake device and, by self-locking, can ensure that the intake device can dwell in any desired height positions. In the moved-out and moved-back end positions, appropriately disposed limit switches switch off the motor. Lateral outward pivoting is made possible by a tubular column that is disposed on a longitudinal side and through which the drawn-in hot-food vapors can be transported away through a suction device disposed at a distance. The outward pivoting is advantageously carried out by hand because it provides better alignment of the intake region with the area where vapors are to be drawn away. To return from the pivoting position into the original position, in which the intake device can be moved downward finally into the locking position, there is, for each of the two outward-pivoting sides, a slotted guide that, flush-mounted, acts on the tubular column.

In accordance with a further feature of the invention, there is provided a slotted guide connected to the height adjustment device and the pivot. The slotted guide controls a pivoting position of the intake section as a function of the vertical position of the intake section.

In accordance with an added feature of the invention, there are provided a housing body and bearing blocks fixedly disposed in the housing body. The pipe axially mounts the intake section and the bearing blocks guide movement of the pipe with respect to the housing body. Preferably, there are provided drive members and the bearing blocks are coupled to the drive motor in an axial direction of the pivot axis through the drive members for setting a height of the intake section.

In accordance with an additional feature of the invention, the housing body has regions disposed at a distance from one another, the bearing blocks include a guide block and two identical bearing blocks, a column assembly aligns the two bearing blocks with respect to one another at regions of the housing body distant from one another, and the guide block is disposed between the two bearing blocks, is substantially similar in construction to the two bearing blocks, is axially fixedly connected to the pipe, is rotatably connected to the pipe, and is displaceably disposed on the column assembly. Preferably, the guide block is connected to the drive motor through the gear assembly.

In accordance with yet another feature of the invention, there are provided two deflecting rollers and a toothed belt connecting the guide block to the drive motor through the gear assembly. The toothed belt is guided parallel to the pipe through the two deflecting rollers.

In accordance with yet a further feature of the invention, one of the two deflecting rollers is a toothed belt wheel coupled to the drive motor through the gear assembly.

In accordance with yet an added feature of the invention, the pivot point is centered in the opening.

In accordance with a concomitant feature of the invention, the side of the area has a depth axis and the intake section has two end sections and a longitudinal center axis spanning from one of the end sections to another of the end sections and the longitudinal center axis is parallel to the depth axis.

Other features that are considered as characteristic for the invention are set forth in the appended claims.

Although the invention is illustrated and described herein as embodied in a vapor extraction device disposed in the region next to cooking or other open hot-food areas, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
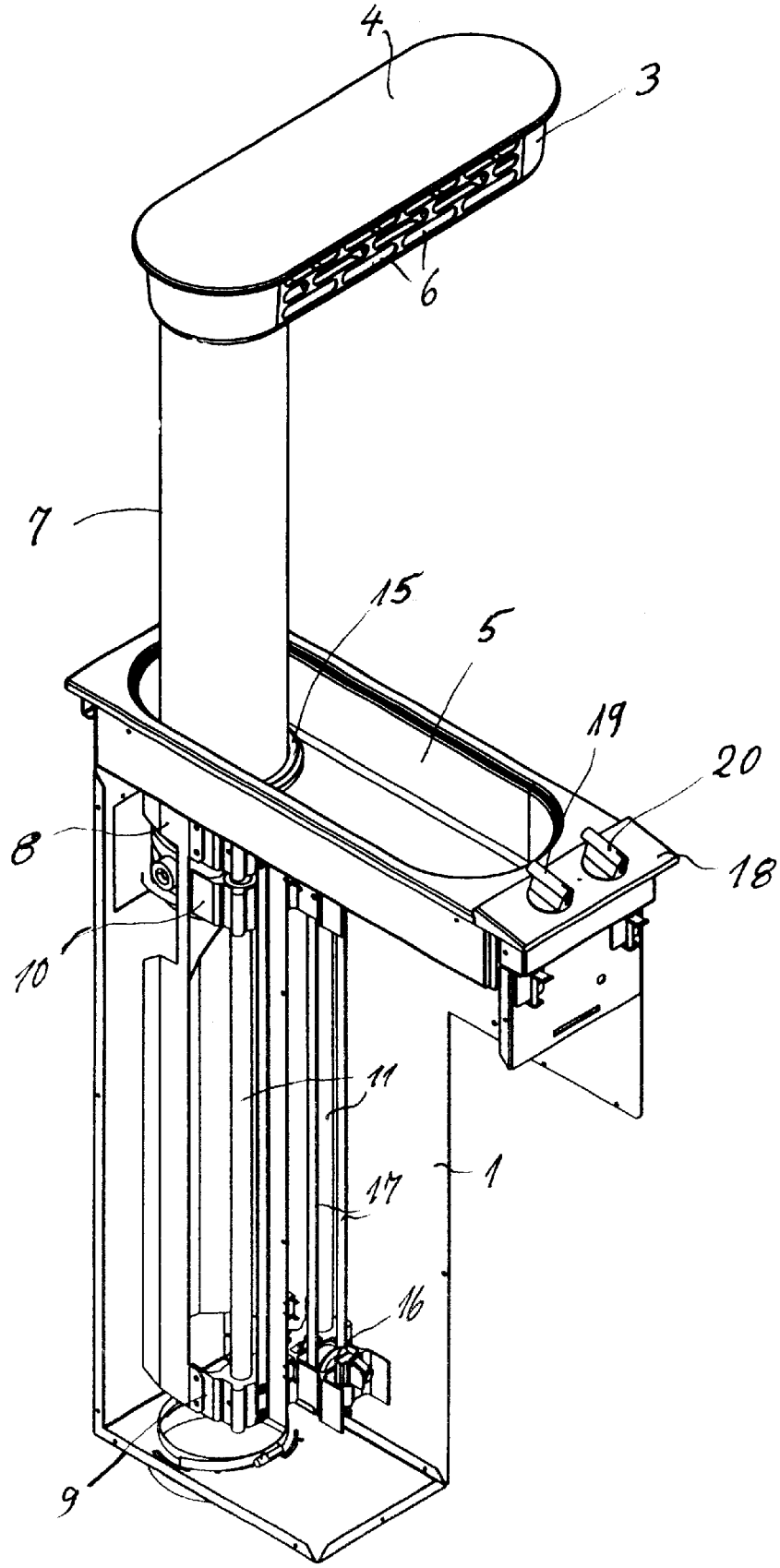
FIG. 1 is a diagrammatic, perspective, partially cut away view of the vapor extraction device according to the invention with a bearing and intake region in an extended and pivoted position.

In all the figures of the drawing, sub-features and integral parts that correspond to one another bear the same reference symbol in each case.

Figure 2:
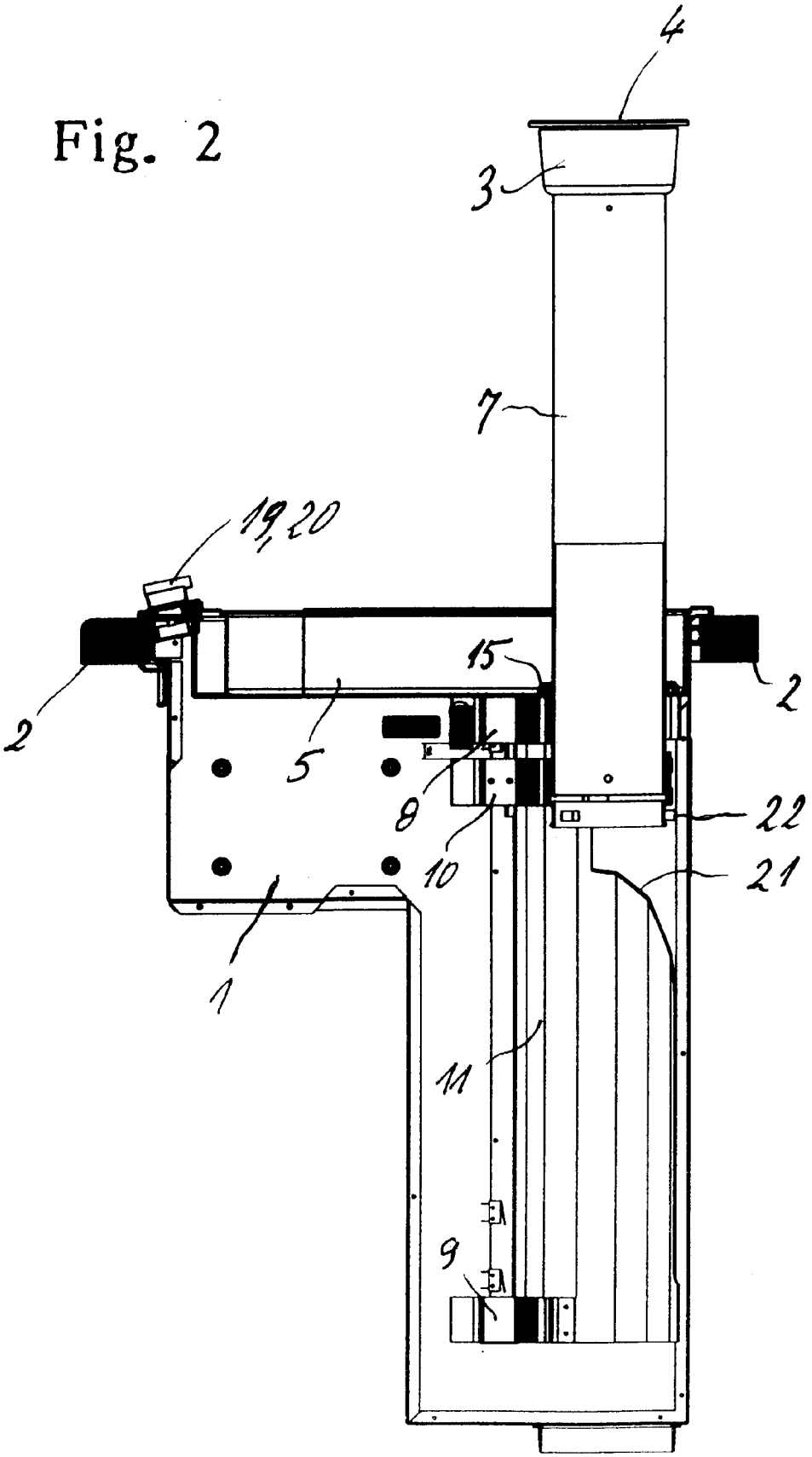
FIG. 2 is a cross-sectional, partially cut away, side view of the device of FIG. 1.
Figure 3:
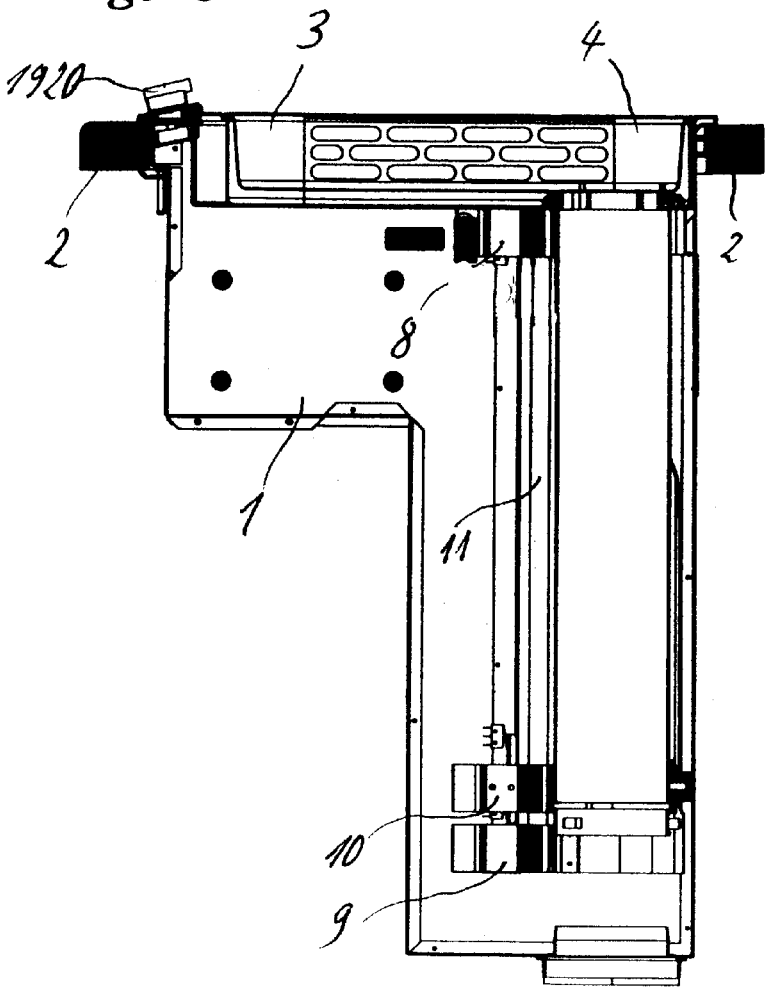
FIG. 3 is a cross-sectional, partially cut away, side view of the device of FIG. 2 with the intake region in a closed position.
Figure 4:
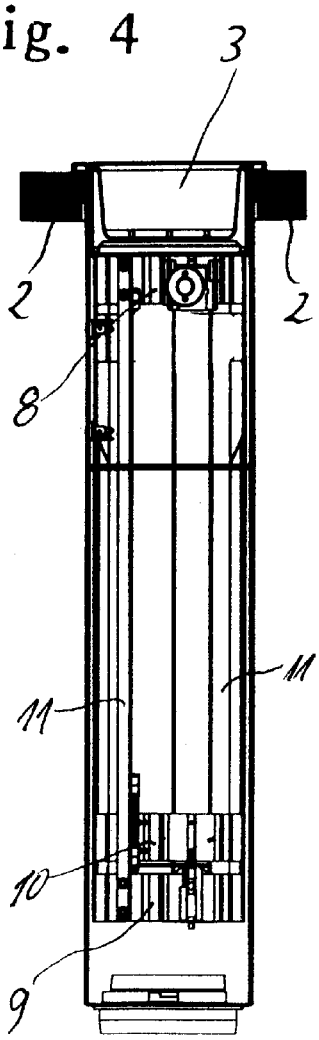
FIG. 4 is a cross-sectional view of the device of FIG. 3 rotated 90° counter-clockwise.
Figure 5:
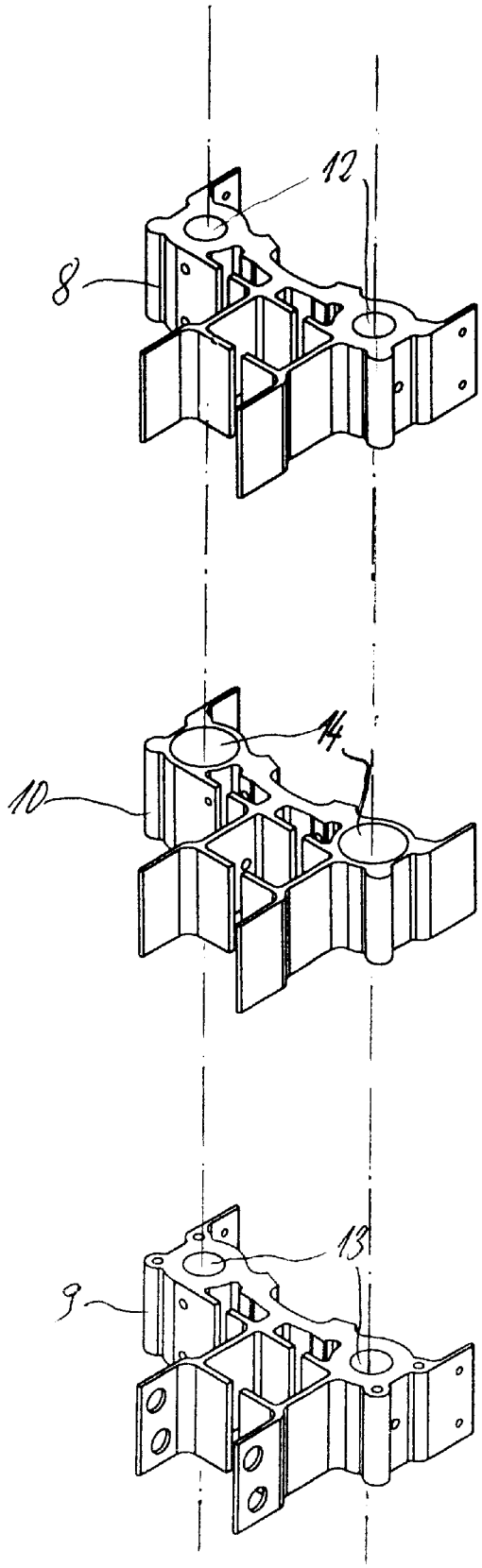
FIG. 5 is a perspective view of fastening blocks for the configuration of FIG. 1 disposed one above the other with a guide block disposed therebetween.

Referring now to the figures of the drawings in detail and first, particularly to FIG. 1 thereof, there is shown part of a vapor extraction device that can be inserted into a recess of a cooktop next to or between open hot-food areas of a kitchen. Such open hot-food areas may be, for example, a recessed cooktop with one or more cooking points or a grill or fryer inserted into the cooktop. FIG. 1 illustrates the intake device of the invention in a position in which it is moved out into the working position. FIG. 2 illustrates a side view of FIG. 1, together with the cooktop 2 receiving the housing 1 of the configuration. FIGS. 3 and 4 illustrate these configurations, but with the intake device 3 moved into the rest position. Here, the upper limiting plate 4, which is constructed to be removable and closed, is in the plane of the adjacent non-illustrated open hot-food area so that it effectively shields its receiving trough 5 and, therefore, the housing interior from dirt. Intake orifices 6 for receiving the hot-food vapors to be drawn in are disposed on both sides of the intake device 3. Located behind the intake orifices 6, inside the intake device, is a non-illustrated filter material that can be taken out for cleaning purposes or exchanged after the upper limiting plate 4 has been lifted off. The intake device 3 is disposed at the upper end of a tubular column 7, through which the vapors drawn in through the orifices 6 of the intake device 3 can be discharged downward, specifically under the influence of a non-illustrated blower, which is accommodated, for example, in the plinth region of the kitchen furniture and is connected fluidically to the lower end of the tubular column 7 through a non-illustrated flexible pipe connection. To ensure that operation is free of faults and as free of jolts as possible when the intake device 3 is being moved out, pivoted outward, and moved back through the tubular column 7, a stable guide configuration is required, the essential constituents of which are an upper bearing block 8, a lower bearing block 9 and a guide block 10, disposed between them, in conjunction with two connection and guide columns or rods 11. The basic construction of the three blocks 8, 9, 10 is essentially identical in cross section, so that these blocks can be produced from extruded aluminum profile with relatively cost-effective precision as parts cut to size and, if appropriate, so as to be capable of being remachined with regard to modifications. The bearing blocks 8 and 9 are disposed in the upper and lower regions of the housing 1 and are firmly connected through their receiving bores 12 and 13 to the guide rods 11. The guide block 10, in turn, is fastened firmly to the lower end of the tubular column 7 and is longitudinally displaceable on the guide rods 11 through non-illustrated ball-bearing guides disposed in its bores 14. The tubular column 7 is mounted so as to be longitudinally displaceable and rotatable in a guide ring 15 of the receiving trough 5.

Deflecting rollers 16 for a toothed belt 17 guided in rotation are disposed on the bearing blocks 8 and 9. One flank of the toothed belt is connected firmly to the guide block 14. The upper deflecting roller 16, in turn, is constructed as a toothed-belt wheel. The upper deflecting roller 16 is connected to a drive motor, through which the guide block 14, the tubular column 7 firmly connected axially to the guide block 15 but pivotable relative to it, and, consequently, the intake device 6 are, therefore, vertically adjustable. Through a switch 19 disposed in the operating area 18, the moving-out and engaging movements in the axial direction can be achieved by the drive motor by deflection to the left and to the right respectively. The further switch 20 serves for activating the non-illustrated blower.

Slotted guides 21 are disposed in the housing 1 flanking the tubular-shaped column 7. A guide pin 22 fastened to the tubular column 7 runs onto the slotted guides 21 when the column 7 and, together with it, the intake device 3, are guided back into the initial position, such that the intake device 3 is pivoted out of the hot-food area into a position parallel to the receiving trough 5 and can be moved back there into the rest position. Limit switch contacts serve for switching off the drive motor when the upper and the lower end positions are reached.

We claim:

1. A vapor extraction device disposed in a region next to an open hot-food area for food preparation, comprising:

a suction device for moving and discharging vapors from an open hot-food area;

a length-compensating pipe having a pipe axis, said pipe fluidically connected to said suction device;

an intake having:

an elongated intake section for receiving the vapors emanating from the area, said elongated intake section having end sections, one of said end sections defining an opening connected to said pipe and fluidically coupled to said suction device through said pipe, said opening having a pivot point;

a height adjustment device configured to move said intake section from a closed position approximately in a plane defined by the area to open positions at different vertical heights above the plane of the area including a height above a food preparation container placed onto the area; and a pivot having a pivot axis passing through said pivot point and corresponding to said pipe axis, said pivot configured to move said intake section about said pivot axis as a function of a vertical position of said intake section and to a position over the area; and said intake, said pivot axis, said pipe, and said pipe axis being disposed at the area.

2. The vapor extraction device according to claim 1, including:

a motor drive;

a gear assembly being connected to said motor drive;

said gear assembly being connected to said height adjustment device; and said motor drive driving said height adjustment device through said gear assembly.

3. The vapor extraction device according to claim 2, including:

a housing body;

bearing blocks fixedly disposed in said housing body;

drive members;

said pipe axially mounting said intake section;

said bearing blocks guiding said pipe with respect to said housing body; and said bearing blocks being coupled to said drive motor in an axial direction of said pivot axis through said drive members for setting a height of said intake section.

4. The vapor extraction device according to claim 3, wherein:

said housing body has regions disposed at a distance from one another;

said bearing blocks include a guide block and two identical bearing blocks;

a column assembly aligns said two bearing blocks with respect to one another at regions of said housing body distant from one another;

said guide block:

is disposed between said two bearing blocks;

is substantially similar in construction to said two bearing blocks;

is axially fixedly connected to said pipe;

is rotatably connected to said pipe;

is displaceably disposed on said column assembly; and is connected to said drive motor through said gear assembly.

5. The vapor extraction device according to claim 4, including:

two deflecting rollers;

a toothed belt connecting said guide block to said drive motor through said gear assembly; and said toothed belt being guided parallel to said pipe through said two deflecting rollers.

6. The vapor extraction device according to claim 5, wherein one of said two deflecting rollers is a toothed belt wheel coupled to said drive motor through said gear assembly.

7. The vapor extraction device according to claim 1, including a slotted guide connected to said height adjustment device and said pivot, said slotted guide controlling a pivoting position of said intake section as a function of said vertical position of said intake section.

8. The vapor extraction device according to claim 1, including:

a housing body;

bearing blocks being fixedly disposed in said housing body;

said pipe axially mounting said intake section; and said bearing blocks guiding movement of said pipe with respect to said housing body.

9. The vapor extraction device according to claim 8, wherein:

said housing body has regions disposed at a distance from one another;

said bearing blocks include a guide block and two identical bearing blocks;

a column assembly aligns said two bearing blocks with respect to one another at regions of said housing body distant from one another;

said guide block:

is disposed between said two bearing blocks;

is substantially similar in construction to said two bearing blocks;

is axially fixedly connected to said pipe;

is rotatably connected to said pipe; and is displaceably disposed on said column assembly.

10. The vapor extraction device according to claim 1, wherein said pivot point is centered in said opening.

11. The vapor extraction device according to claim 1, wherein:

the side of the area has a depth axis; and said intake section has two end sections and a longitudinal center axis spanning from one of said end sections to another of said end sections and said longitudinal center axis is parallel to said depth axis.

12. A vapor extraction device disposed in a region next to an open hot-food area for food preparation, comprising:

a means for moving and discharging vapors from an open hot-food area;

a length-compensating pipe having a pipe axis, said pipe fluidically connected to said discharging means;

an intake having:

an elongated intake section for receiving the vapors emanating from the area, said elongated intake section having end sections, one of said end sections defining an opening connected to said pipe and fluidically coupled to said discharging means through said pipe, said opening having a pivot point;

a means for adjusting a height of said intake for moving said intake section from a closed position approximately in a plane defined by the area to open positions at different vertical heights above the plane of the area including a height above; and a means for pivoting said intake section about said pivot axis as a function of a vertical position of said intake section and to a position over the container placed at the area, said pivoting means having a pivot axis passing through said pivot point and corresponding to said pipe axis; and said intake, said pivot axis, said pipe, and said pipe axis being disposed at the area.

13. The vapor extraction device according to claim 12, wherein said discharging means is a suction device.

14. A vapor extraction device disposed in a region next to an open hot-food area for food preparation, comprising:

a suction device for moving and discharging vapors from an open hot-food area;

a length-compensating pipe having a pipe axis, said pipe fluidically connected to said suction device;

an elongated intake section for receiving the vapors emanating from the area, said elongated intake section having end sections, one of said end sections defining an opening connected to said pipe and fluidically coupled to said suction device through said pipe, said opening having a pivot point;

a height adjustment device configured to move said intake section from a closed position approximately in a plane defined by the area to open positions at different vertical heights above the plane of the area including a height above a food preparation container placed onto the area;

a pivot having a pivot axis passing through said pivot point and corresponding to said pipe axis, said pivot configured to move said intake section about said pivot axis to a position over the area;

a controller for controlling the pivot position of said intake section as a function of a vertical position of said intake section; and said intake, said pivot axis, said pipe, and said pipe axis being disposed at the area.

15. A vapor extraction device disposed in a region next to an open hot-food area for food preparation, comprising:

a suction device for moving and discharging vapors from an open hot-food area;

a length-compensating pipe having a pipe axis, said pipe fluidically connected to said suction device;

an elongated intake section for receiving the vapors emanating from the area, said elongated intake section having end sections, one of said end sections defining an opening connected to said pipe and fluidically coupled to said suction device through said pipe, said opening having a pivot point;

a height adjustment device configured to move said intake section from a closed position approximately in a plane defined by the area to open positions at different vertical heights above the plane of the area including a height above a food preparation container placed onto the area;

a pivot having a pivot axis passing through said pivot point and corresponding to said pipe axis, said pivot configured to move said intake section about said pivot axis to a position over the area;

a means for controlling the pivot position of said intake section as a function of a vertical position of said intake section; and said intake, said pivot axis, said pipe, and said pipe axis being disposed at the area.

* * * * *